US010993534B1

(12) United States Patent
Pike

(10) Patent No.: US 10,993,534 B1
(45) Date of Patent: May 4, 2021

(54) TABLE FOR MITIGATING INFECTIOUS DISEASE

(71) Applicant: Jonathan Pike, Houston, TX (US)

(72) Inventor: Jonathan Pike, Houston, TX (US)

( * ) Notice: Subject to any disclaimer, the term of this patent is extended or adjusted under 35 U.S.C. 154(b) by 0 days.

(21) Appl. No.: 17/078,072

(22) Filed: Oct. 22, 2020

(51) Int. Cl.

| | |
|---|---|
| ***A47B 97/00*** | (2006.01) |
| ***A47B 13/08*** | (2006.01) |
| ***F24F 7/06*** | (2006.01) |
| ***A47B 13/00*** | (2006.01) |
| ***A47B 31/02*** | (2006.01) |
| ***A47B 37/00*** | (2006.01) |

(52) U.S. Cl.
CPC ..... *A47B 97/00* (2013.01); *A47B 13/08* (2013.01); *F24F 7/06* (2013.01); *A47B 13/00* (2013.01); *A47B 31/02* (2013.01); *A47B 37/00* (2013.01); *A47B 2200/0019* (2013.01); *A47B 2200/0084* (2013.01); *A47B 2200/02* (2013.01); *A47B 2200/06* (2013.01); *F24F 2221/10* (2013.01)

(58) Field of Classification Search
CPC ... A47B 37/00; A47B 2037/005; A47B 97/00; A47B 2200/02; A47B 2200/03; A47B 2200/060019; A47B 13/00; A47B 31/02; F24F 7/06; F24F 2221/10
USPC ..... 108/50.13
See application file for complete search history.

(56) References Cited

U.S. PATENT DOCUMENTS 2,507,634 A * 5/1950 Hill ..... F24F 13/0604 454/231
3,442,230 A * 5/1969 Polen ..... B01L 9/02 108/24
3,766,906 A * 10/1973 Jenn ..... A47J 37/0682 126/299 R (Continued)

FOREIGN PATENT DOCUMENTS

CH 714120 A2 * 3/2019 ..... F24F 1/0007
CN 205251707 U 5/2016

(Continued)

OTHER PUBLICATIONS

Ashrae Board of Directors, "ASHRAE Position Document on Infectious Aerosols", ASHRAE, 2020, 24 pages.

(Continued)

*Primary Examiner* — Daniel J Rohrhoff
(74) *Attorney, Agent, or Firm* — Klein, O'Neill & Singh, LLP

(57) ABSTRACT

Tables for mitigating infectious disease spread are disclosed having at least two seating areas that are configured to minimize the transfer of aerosolized droplets among the seating areas. Between each seating area are a series of impermeable barriers—at least one hanging impermeable barrier that projects downwards towards a top surface of a table and at least one rising impermeable barrier that projects upwards away from a top surface of a table. The impermeable barriers are disposed to overlap one another along a line of sight between seating areas such that a bottom edge of the hanging impermeable barrier is at a height above (Continued)

the top edge of the rising impermeable barrier. Vacuum mechanisms can be positioned above the hanging impermeable barriers and below the rising impermeable barriers to create airstreams along the impermeable barriers that guide airborne particulate matter blocked by an impermeable barrier into a vacuum mechanism.

19 Claims, 5 Drawing Sheets

(56) References Cited

U.S. PATENT DOCUMENTS 4,248,162 A 2/1981 Skeist
4,353,411 A * 10/1982 Harter ..... F24F 7/04 165/129
4,623,367 A * 11/1986 Paulson ..... B01D 46/10 108/50.12
4,974,915 A * 12/1990 Bussard ..... A47B 49/00 108/50.11
5,085,134 A * 2/1992 Hofstra ..... A24F 47/00 454/344
5,267,895 A * 12/1993 Mitchell ..... F24F 3/1607 454/57
5,350,337 A * 9/1994 Kondo ..... F24F 9/00 454/189
5,417,433 A * 5/1995 Phillips ..... F24F 9/00 273/309
5,441,279 A * 8/1995 Messina ..... A47B 37/00 273/309
5,542,438 A 8/1996 Adams
5,562,286 A * 10/1996 Brinket ..... A47B 25/00 273/309
5,716,268 A 2/1998 Strongin
5,775,987 A * 7/1998 Brinket ..... A47B 13/00 454/341
5,944,024 A * 8/1999 Ambrosio ..... A24F 19/0042 131/231
D424,678 S 5/2000 Holmgren
6,217,437 B1 * 4/2001 Murray ..... A01K 1/031 119/419
6,298,866 B1 * 10/2001 Molnar, IV ..... A45B 3/00 108/50.12
6,318,113 B1 * 11/2001 Levy ..... F24F 3/044 454/306
6,471,754 B2 * 10/2002 Ammouri ..... B03C 3/32 131/202
6,802,266 B2 * 10/2004 Cheng ..... B01D 46/02 108/50.13
7,198,567 B2 * 4/2007 Casey ..... B08B 15/002 454/49
7,513,126 B2 * 4/2009 Boland ..... A45B 3/00 62/310
7,537,015 B1 * 5/2009 Molnar, IV ..... A45B 23/00 108/50.12
9,050,382 B2 * 6/2015 Carr ..... A61L 9/02
9,101,727 B2 8/2015 Self
10,620,645 B2 * 4/2020 Clark ..... F24F 11/30
10,697,190 B2 6/2020 McDuffie
2001/0003264 A1 * 6/2001 Shapton ..... A47B 5/06 108/50.02
2003/0101915 A1 * 6/2003 Lin ..... G09B 23/28 108/50.13
2004/0224628 A1 11/2004 Niu
2011/0039491 A1 2/2011 Khalifa
2011/0146542 A1 * 6/2011 Branning ..... F24H 3/02 108/50.13
2011/0287708 A1 * 11/2011 Timko ..... F24F 9/00 454/338
2014/0060396 A1 * 3/2014 Landvik ..... A47B 37/00 108/50.13
2014/0096707 A1 * 4/2014 Westbrook ..... A47B 13/00 108/26
2020/0231128 A1 7/2020 Bailey
2021/0025605 A1 * 1/2021 Bullister ..... F24F 13/28

FOREIGN PATENT DOCUMENTS

CN 207544652 U 6/2018
CN 208998221 U 6/2019
CN 210203886 U 3/2020
DE 202020103435 U1 * 7/2020 ..... A47F 10/00
EP 0831279 A1 * 3/1998 ..... F24F 3/1603
EP 1630485 A2 * 3/2006 ..... F24F 1/005
JP 06343519 A * 12/1994
JP 09322829 A * 12/1997 ..... B08B 15/02
WO WO-2013021466 A1 * 2/2013 ..... F24F 7/00
WO WO-2013156805 A2 * 10/2013 ..... A47B 37/00

OTHER PUBLICATIONS

Ashrae, "ID Does ASHRAE's guidance agree with guidance from WHO and CDC?" no date, 1 page.
Nissen et al., "Long-distance airborne dispersal of SRS-COV-2 in COVID-19 wards", Scientific Reports, 2020, 10:19589, 9 pages.
Lu et al., "COVID-19 Outbreak Associated with Air Conditioning in Restaurant, Guangzhou, China, 2020", Emerging Infectious Diseases, www.cdc.gov/eid, vol. 26, No. 7, Jul. 2020, 4 pages.
Qian et al., "Removal of exhaled particles by ventilation and deposition in a multibed airborne infection isolation room", Indoor Air 2010 20, 284-297.
Philips, "Ultraviolet purification application information", 2006 Koninklijke Philips Electronics NV, 16 pages.
Yang et al., "Performance evaluation of a novel personalized ventilation-personalized exhaust system for airborne infection control", Indoor Air 2015, 25, 176-187.
Morawska et al., "It Is Time to Address Airborne Transmission of Coronavirus Disease 2019 (COVID-19)", Clinical Infectious Diseases, 2020:71, 2311-2313.
Qian et al., "Ventilation control for airborne transmission of human exhaled bio-aerosols in buildings", J Thorac Dis 2018, 10 (Suppl 19) S2295-S2304.

* cited by examiner

TABLE FOR MITIGATING INFECTIOUS DISEASE

CROSS-REFERENCE TO RELATED APPLICATIONS

None

FEDERALLY SPONSORED RESEARCH OR DEVELOPMENT

Not Applicable

BACKGROUND

When two people share a table with one another, germs that reside on one person can be transferred to another person in a myriad of ways. This is especially true when the people who share the table are eating and drinking food and drinks at the table without wearing a mask. The number of germs that are transferred between one person and another sharing a table can be minimized by wearing safety gear, such as gloves, and masks, and by taking safety precautions, such as not touching the same item on the table, by washing hands frequently, or by not facing another person sharing the table while talking. However, such measures can be uncomfortable to take, particularly when sharing a table while dining or sharing a table while gambling.

It would therefore be desirable to have improved safety measures and devices that could be used when sharing a table.

SUMMARY OF THE INVENTION

Systems and methods for mitigating infectious disease spread while sharing a table are disclosed. An apparatus for a table provides a series of impermeable barriers between a first user seating area and a second user seating area. The series of impermeable barriers prevent germ-carrying materials, such as aerosolized droplets, from traveling along a direct line-of-sight path from one seating area to another seating area.

At least one hanging impermeable barrier projecting downwards towards a top surface of a table and at least one rising impermeable barrier projecting upwards away from a top surface of a table are positioned between at least two seating areas at the table. The upper edge of a rising impermeable barrier is disposed above a lower edge of a hanging impermeable barrier to block a direct line-of-sight path from one seating area to another seating area. The impermeable barriers preferably comprise a transparent material, such as transparent glass or transparent plastic, to allow people sitting in the seating areas to view one another through the barriers along the blocked line-of-sight path. In some embodiments, a central hanging impermeable barrier could be disposed that projects downwards towards the table between a first and second seating area. Particulate matter that travels from one seating area towards the other seating area that is located above the bottom edge of the central hanging impermeable barrier will be blocked by the central hanging impermeable barrier. A first rising impermeable barrier and a second rising impermeable barrier could both project upwards away from the table and each could be disposed on opposing sides of the central impermeable barrier. Any particulate matter that travels from one seating area towards the other seating area that is located below the top edges of the first and second rising impermeable barriers would be blocked by the first and second impermeable barriers, respectively. The first rising impermeable barrier could also be angled to project towards the first user seating area and the second rising impermeable barrier could also be angled to project towards the second user seating area to provide a sloped surface that leads towards a lower vacuum mechanism. Preferably, the top edges of both of the rising impermeable barriers are located at a height above the lower edge of the central hanging impermeable barrier.

In some embodiments, at least two vacuum mechanisms are provided that sucks or draws air between the first and second seating areas towards the vacuum mechanisms. At least one upper vacuum mechanism sucks air between the first and second user seating areas towards an upper direction, such as the ceiling of a room or towards an input port of the upper vacuum mechanism disposed above the table. At least one lower vacuum mechanism sucks air between the first and second user seating areas towards a lower direction, such as into an opening in the surface of the table or into an area below the table. In some embodiments, multiple upper and/or lower vacuum mechanism s could be used to suck air between one or more seating areas at a table towards the vacuum mechanism s. In some embodiments, each vacuum mechanism at a table could be configured to direct air pulled from the first and second seating areas towards a common location via one or more conduits, such as a centralized air conditioning unit or a cleaning and filtration system.

In some embodiments, the upper vacuum mechanism is disposed to draw air upwards on both sides of the central hanging impermeable barrier, for example by projecting the central hanging impermeable barrier from an opening from the upper vacuum mechanism. Such a configuration allows particulate matter that is blocked by the central hanging impermeable barrier to be drawn upwards towards the upper vacuum mechanism from either side of the central hanging impermeable barrier. In some embodiments, a first and second hanging impermeable barrier are disposed above the first and second user seating areas, respectively, to help funnel particulate matter towards the upper vacuum mechanism. The first and second hanging impermeable barriers could also be angled to project towards the first and second user seating areas (away from one another), respectively, to provide a sloped surface that guides an airstream from a seating area towards an input port of the upper vacuum mechanism.

In some embodiments one or more lower vacuum mechanisms are disposed on opposing sides of the first and second impermeable barriers, for example by projecting from an opening in the lower vacuum mechanism. Such a configuration allows particulate matter that is blocked by the first and second impermeable barriers to be drawn downwards towards the lower vacuum mechanism. By disposing both the vacuum mechanisms and the impermeable barriers in such a manner, not only do the impermeable barriers block particulate matter from traveling across the barriers towards another seating area, but the particulate matter also cannot hang in the air to slowly travel around the impermeable barriers, as such slowly moving particulate matter would be drawn into both the upper vacuum mechanism and the lower vacuum mechanism.

While two seating areas with impermeable barriers and vacuum mechanisms disposed between them are described in the summary above, tables having additional seating areas could have additional impermeable barriers and vacuum mechanisms situated similarly about the table to minimize infectious disease spread between the separated seating areas in other embodiments. For example, a long table could have impermeable barriers and vacuum mechanisms disposed at intervals along the length of the table to divide one side of the table from another side of the table. Impermeable barriers and vacuum mechanisms could also be disposed between seating areas on the same side of a table as well. In embodiments having a circular or a semi-circular table, both upper and lower impermeable barriers could be disposed between members sitting on a same side of the table, but only upper impermeable barriers could be disposed between a user seating area and the center of the table. Such a configuration allows users to take items, such as food or cards from a center of the table, while being isolated from particulate matter traveling towards them from user seating areas at the sides.

Other variations on the disclosed embodiments are envisioned, as explained in the detailed description below.

DETAILED DESCRIPTION

Figure 1:
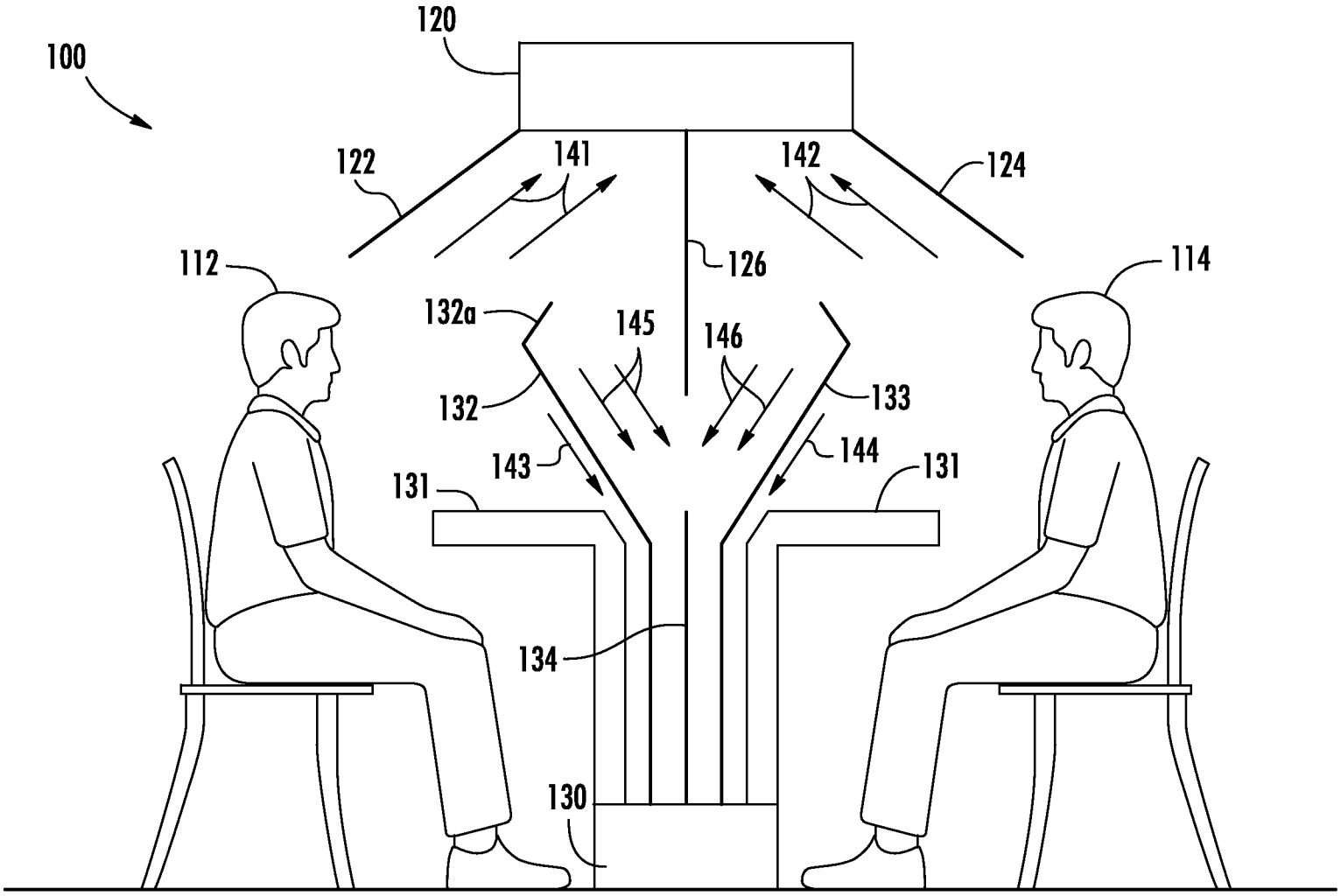
FIG. 1 shows a side cross-sectional view of a table that mitigates infectious disease spread between two people sitting at the table.

The following detailed description describes table embodiments that are designed to mitigate infectious disease spread between people sitting at the table.

Various designs of tables having vacuum mechanisms and impermeable barriers could be utilized to mitigate infectious disease spread between people sitting at a table. Four different exemplary tables are shown in FIGS. 1-5 as the tables 100, 200, 300, and 400. An exemplary table typically has a series of impermeable barriers that project upwards and downwards in an overlapping manner to prevent an aerosolized droplet from traveling from one seating area to another seating area via a direct line-of-sight pathway. For example, the table 100 has a hanging impermeable barrier 126 that projects downwards towards the table surface 131 and a pair of rising impermeable barriers 132, 133 that project upwards away from the table surface 131. Preferably, the upper edge of the rising impermeable barriers 132, 133 are configured to be above the lower edge of the hanging impermeable barrier 126. An aerosolized droplet traveling from one user seating area to another user seating area would need to zig-zag through the air in order to pass from one seating area to the next. Likewise, an aerosolized droplet traveling between one seating area to another seating area across the table 200 would need to zig-zag through the air in order to bypass the overlapping hanging impermeable barrier 241 and the pair of rising impermeable barriers 221, 222, that project upwards away from the table surface 280. Contemplated impermeable barriers comprise a transparent or a translucent material that allow people sitting in different seating areas to look at and talk to one another.

While aerosolized droplets can hang in the air and may eventually zig-zag through the air to travel from one seating area to another in rooms having stagnant air, contemplated tables may have upper and lower vacuum mechanisms that are disposed on opposing sides of the impermeable barriers in a manner to draw aerosolized droplets in such a flight path upwards towards an upper vacuum mechanism and/or downwards towards a downward vacuum mechanism. For example, the table 100 has an upper vacuum mechanism 120 that draws air upwards via airstreams 141 and 142, and a lower vacuum mechanism that draws air downwards via airstreams 143, 144, 145, and 146. Likewise, the table 200 has a lower vacuum mechanism that draws air downwards via airstreams 251, 252, 253, and 254. While the table 200 does not show an upper vacuum, the top edge of the upper projection 241 could be disposed under an upper vacuum mechanism, similar to the upper vacuum mechanism 120 shown in FIG. 1, to help prevent aerosolized droplets from traveling over the upper projection 241, or could be wedged under a ceiling or other barrier disposed above the table surface 280 to prevent aerosolized droplets from traveling over the upper projection 241 from one seating area to another.

While only two seating areas are shown in the tables 100 and 200, similar configurations could be utilized for any rectangular table to mitigate infectious disease spread between seating areas at a table. In some embodiments, overlapping impermeable barriers and vacuum mechanisms could be arranged along an entire length of a table to completely bisect a table in half, allowing for a first household to sit on one side of the table and a second household to sit on another side of the table while mitigating infectious disease spread between the households.

Figure 4:
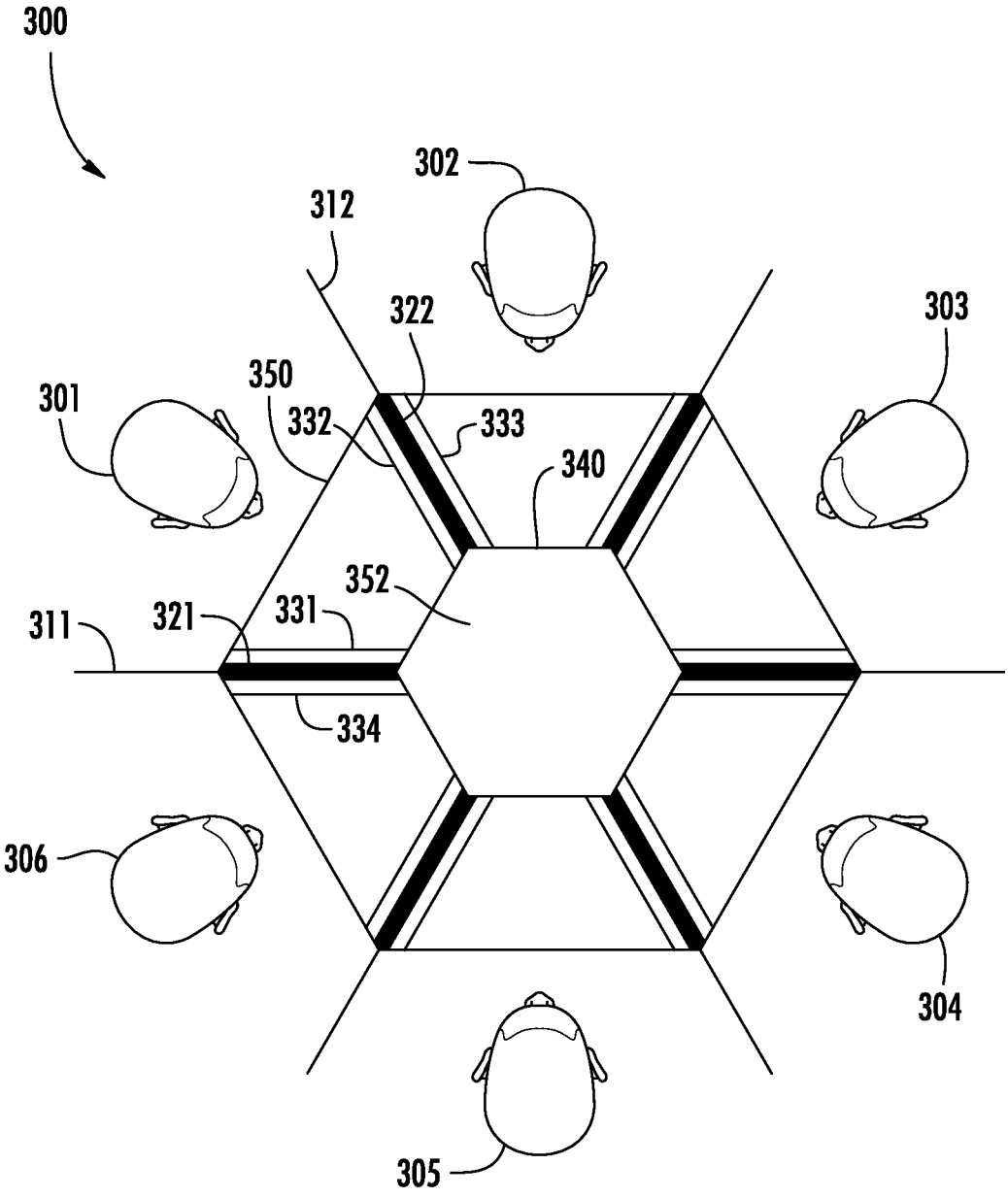
FIG. 4 shows a top plan view of an alternative table that mitigates infectious disease spread between six people sitting at a table.
Figure 5:
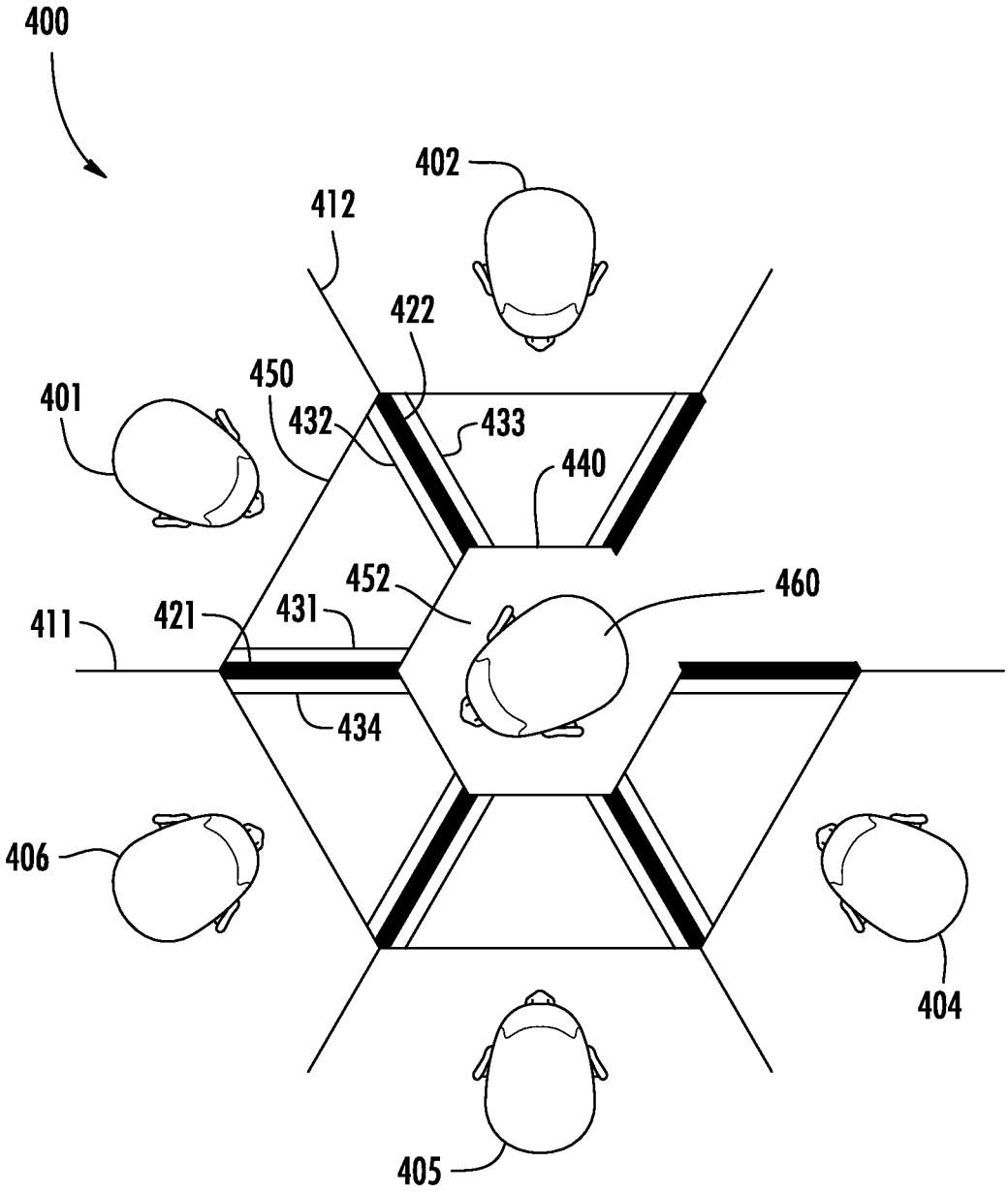
FIG. 5 shows a top plan view of an alternative table that mitigates infectious disease spread between five people sitting at a table and a server located behind a barrier at the table.

In some embodiments, the impermeable barriers and vacuum mechanisms could be disposed between table settings on a same side of a table to mitigate infectious disease spread between seating areas that are located side-by-side one another, as is shown by the tables 300 and 400 shown in FIGS. 4 and 5, respectively. With regards to the table 300, the seating areas 301, 302, 303, 304, 305, and 306 are substantially isolated from one another via overlapping hanging and rising impermeable barriers and vacuum mechanisms, similar to those for the table 100 and the table 200. As shown, the seating area 301 is isolated from the seating area 306 by a hanging impermeable barrier 311 projecting downwards towards the table surface 350 and a pair of rising impermeable barriers 331, 334, that project upwards away from the table surface 350. Any aerosolized droplets that travel between the seating area 301 and the seating area 306 are sucked downwards towards the lower vacuum mechanism 321. The seating area 301 is also isolated from seating area 302 by a hanging impermeable barrier 312 projecting downwards towards the table surface 350 and a pair of rising impermeable barriers 332, 333 that project upwards away from the table surface 350. Any aerosolized droplets that travel between the seating area 301 and the seating area 302 are sucked downwards towards the lower vacuum mechanism 322.

A center 352 of the table 300 could be shared among the seating areas 301, 302, 303, 304, 305, and 306 to allow the diners to share food among one another while a hanging impermeable barrier 340 projects downwards towards the table surface 350 to minimize droplet spread towards the shared center of the table 352. An upper vacuum mechanism (not shown) could be disposed above the table 300 to draw air upwards that is blocked by any of the hanging impermeable barriers 340, 312, and 311.

In another contemplated embodiment, the table 400 could be used to allow a common server 460 to distribute items, such as food in a restaurant setting or cards in a casino setting, to each of the seating areas 401, 402, 404, 405, and 406 from a center area 452 of the shared table 400. Similar to the table 300 shown in FIG. 4, the seating areas 401, 402, 404, 405, and 406 could be substantially isolated from one another via overlapping hanging and rising impermeable barriers and vacuum mechanisms. However, instead of allowing each person in each seating area to reach towards the center of the table, the common server 460 could distribute items from the center area 452 to each of the seating areas along the edges of the table 400, helping to mitigate the spread of infectious diseases by allowing one masked, hygienic entity to distribute items to each of the seating areas 401, 402, 404, 405, and 406 from a centralized location.

An impermeable barrier may comprise a barrier that does not allow matter to flow through the material from one side to another side. By way of example and not limitation, the impermeable barrier may comprise a material that is air-impermeable and/or liquid-impermeable, to completely prevent small particulate matter from passing through the material through a channel or by soaking through the material. Small particulate matter may be aerosolized viruses. Although an impermeable barrier has been described as completely preventing air or liquid to pass through the barrier, it is also contemplated that impermeable barrier may be a barrier that allows some but not all airborne particulates to pass through the barrier (e.g., N95 standard). For example, the barrier may capture most particulates greater than 0.1, 0.2 or 0.3 microns but not less. By allowing for air to pass through the barrier, the people sitting across from each other might be able to hear each other better than if the barrier was completely air or liquid impermeable. The barrier may be transparent or a translucent material, such as glass or plastic, which allows people sitting in seating areas divided by one or more impermeable barriers to see one another.

Barriers that overlap one another have a hanging barrier having a lower edge that is disposed below an upper edge of a rising barrier. In other words, in embodiments where an overlapping rising impermeable barrier projects from an upper surface of a table and an overlapping hanging impermeable barrier projects from the ceiling of a room, the height of the rising impermeable barrier added to the height of the hanging impermeable barrier is greater than the difference between the height of the upper surface of the table and the ceiling of the room.

A vacuum mechanism may comprise a device that draws air towards it via one or more airstreams to an input port of the vacuum mechanism. For example, the vacuum mechanism could be configured to create a pressure differential of at least 5, 10, or 20 InHg (Inch of Mercury) between a point at the input port of the vacuum mechanism and a point at most 1 in. from the input port of the vacuum mechanism. In some embodiments, a vacuum mechanism could comprise an assembly having an input port, an outlet port, and a ventilation unit that draws air from the input port to the outlet port via one or more conduits. In other embodiments, a vacuum mechanism could comprise an input port connecting to a conduit that leads to a ventilation unit that draws air towards it via the conduit. In this manner, each vacuum mechanism could comprise its own ventilation unit, such as a motor or fan, or one or more vacuum mechanisms could comprise input ports having conduits that lead to a common ventilation unit. While most ventilation units draw air towards a vacuum mechanism by using a motor with a fan, other types of ventilation units are envisioned, such as ventilation units that draw air into an input port by lowering the air pressure within an air conduit or by lowering a temperature within an air conduit.

In some embodiments, air collected by a vacuum mechanism could be cleaned using a cleaning mechanism. For example, one or more filters could be disposed at an input port to capture particulate matter traveling via an airstream to the input port of a vacuum mechanism, or could be disposed within the vacuum mechanism itself, to capture particulate matter. In some embodiments, air collected by a vacuum mechanism is cleaned via a multi-step scrubbing process, such as via a HEPA filter that first collects particulate matter, and a UVA filter that then sanitizes air using an ultraviolet light. Preferably, the ultraviolent light renders cellular death of bacteria, or a loss of the ability of a viral pathogen to grow and multiply, within exposure of at least 10, 20, or 30 seconds to the ultraviolet light, which results in a purification of the air with respect to a pathogen's ability to infect a human being. For example, the ultraviolet light could comprise a UVC ultraviolet light having one or more wavelengths between 200 and 300 nm. In some embodiments, the air collected by a vacuum mechanism could be passed to a filtration system before being sent back into a room containing a table. For example, air collected by both an upper and lower vacuum mechanism could be routed to a building's intake system via a pipe, such as a PVC pipe having a circumference between 2-inches to 4 inches, which is configured to filter and clean air via a building's HVAC unit. FIG. 1 shows a side cross-sectional view of a table that is designed to minimize the number of aerosolized droplets that travel between the between two seating areas 112 and 114. While only two people are shown in the diagram, it could be understood that each seating area 112 and 114 could allow for a plurality of people to sit in each seating area along an entire side of the table 100 to bisect people of different households sitting on each side of the table 100.

The table 100 comprises a plurality of hanging impermeable barriers 122, 124, and 126 that each project downwards towards a table surface 131 of the table 100. Here, the hanging impermeable barrier 126 extends downwards towards the table surface 131 of the table 100, having a lower edge that hangs at a height that is lower than an upper edge of both the rising impermeable barriers 132 and 133. By overlapping the impermeable barriers in such a manner, the impermeable barriers block a direct line-of-sight pathway between the seating areas 112 and 114, requiring an aerosolized droplet to zig-zag around the impermeable barriers in order to pass from one seating area to another seating area.

The central hanging impermeable barrier 126 is shown as projecting down from a center of the upper vacuum mechanism 120, for example a fume hood that draws air upwards via airstreams 141 and 142. However, the central hanging impermeable barrier 126 could project from any part of the upper vacuum mechanism 120 in other embodiments. In some embodiments, the central hanging impermeable barrier 126 could project from other suitable materials disposed above the table surface 131 of the table 100, such as a ceiling tile or a beam. In such embodiments, a plurality of upper vacuum mechanisms could be used, such as a first upper vacuum mechanism disposed on one side of the central impermeable barrier 126 to suck air upwards via airstream 141 and a second upper vacuum mechanism disposed on another side of the impermeable barrier 126 to suck air upwards via airstream 142. While the central hanging impermeable barrier 126 is shown as projecting straight vertically downwards towards the table surface 131, the central hanging impermeable barrier 126 could project towards the table surface 131 at any suitable angle, or could be bent along one or more non-straight paths as it projects downwards towards the table surface 131. While a single central hanging impermeable barrier 126 is shown to separate the table seating area 112 from the table seating area 114, a plurality of hanging impermeable barriers could project downwards towards the table surface 131 to direct air to be drawn upwards towards one or more upper vacuum mechanisms disposed on both sides of the hanging impermeable barriers.

The hanging impermeable barriers 122 and 124 are disposed on either side of the central hanging impermeable barrier 126, and act as guides to funnel airborne particulate matter towards the airstreams 141 and 142 drawn upwards by the upper vacuum mechanism 120. While the hanging impermeable barriers 122 and 124 are shown as angling away from one another, towards the seating areas 112 and 114, the hanging impermeable barriers 122 and 124 could be angled in any suitable manner, or could travel along one or more non-linear paths as they project downwards towards the table surface 131. As shown, the lower edges of the hanging impermeable barriers 122 and 124 are disposed at a height above the upper edges of the rising impermeable barriers 132 and 133 in a non-overlapping manner, but could be disposed to be overlapping with the rising impermeable barriers in other embodiments. Such embodiments could be configured to have lower edges that are disposed to be positioned behind a person sitting in the seating areas, respectively.

While the hanging impermeable barriers 122 and 124 are shown as projecting from the lower opposing edges of the upper vacuum mechanism 120, the hanging impermeable barriers 122 and 124 could project from any suitable location from the upper vacuum mechanism 120, or could project from another suitable material disposed above the table surface 131 of the table 100, such as a ceiling tile or a beam of a building. Such material may be juxtaposed to be at or near an edge of an input port of an upper vacuum mechanism, such as the upper vacuum mechanism 120.

The rising impermeable barriers 132 and 133 project from an opening in the table that leads to the lower vacuum mechanism 130, and act as guides to funnel airborne particulate matter traveling between the seating area 112 and 114 towards the airstreams 143, 144, 145, and 146, respectively. While the rising impermeable barriers 132 and 133 are shown as projecting from an opening in the table surface 131 leading to the lower vacuum mechanism 130, the rising impermeable barriers 132 and 133 could project from any opening that leads to an input port of the lower vacuum mechanism 130, such as an opening in the table surface 131 or an opening in a platform that sits on top of an opening of the table surface 131. In some embodiments, the rising impermeable barriers 132 and 133 could project from the table surface 131 itself, which comprises openings between the rising impermeable barriers that act as guides to the lower vacuum mechanism 130. In some embodiments, the rising liquid impermeable barriers could extend from a modular unit that is placed on top of an opening of a table surface, such as the table surface 131, or is coupled to an opening of a table surface. In other embodiments, the rising liquid impermeable barriers could extend from an opening of a conduit that leads to an input of a lower vacuum mechanism. Such a conduit could comprise a hanging divider that extends from a bottom of a table, such as a hanging divider that extends from the bottom of a table opening to a spot about 18 inches from the floor, allowing a lower vacuum to be placed under the hanging divider and draw air downwards along the hanging divider.

While a majority of the length of the rising impermeable barriers 132 and 133 project towards the seating areas 112 and 114, respectively, a portion of the rising impermeable barriers 132 and 133 project away from the seating areas 112 and 114, respectively. Here, the rising impermeable barriers have a bent upper section, such as 132*a*, which projects away from the seating area 112 to help guide and/or deflect air towards the airstream 141 and the upper vacuum mechanism 120. Most airborne particulate matter that drifts over the bent upper section 132*a* but down below the airstream 141 will be drawn towards the airstream 145 into the lower vacuum mechanism 130. A rising impermeable barrier 134 acts as a core to help stabilize the rising impermeable barriers 132 and 133, and could comprise any suitable thickness.

By disposing the impermeable barriers and the vacuum mechanisms in such a manner, a majority of the airborne particulate matter that travels from one seating area to another seating area is captured by either one of the upper vacuum mechanism 120 or lower vacuum mechanism 130. For example, airborne particulate matter that travels from the seating area 112 to the seating area 114 from a person sitting in the seating area 112 would tend to travel towards the lower vacuum mechanism 130 via the airstream 143, guided by the rising impermeable barrier 132, or towards the upper vacuum mechanism 120 via the airstream 141 guided by the hanging impermeable barriers 122 and 126. Any airborne particulate matter that travels above the upper edge of the rising impermeable barrier 132, escapes airstream 141, and falls below the lower edge of projecting impermeable barrier 126 would then tend to travel towards the lower vacuum mechanism 130 via the airstream 145 guided by the projecting hanging impermeable barrier 126, the rising impermeable barrier 143, and the impermeable barrier 134. Any airborne particulate matter that escapes the airstream 145 would then tend to travel towards the lower vacuum mechanism 130 via the airstream 146 guided by the projecting hanging impermeable barrier 126, the rising impermeable barrier 144, and the impermeable barrier 134. Any airborne particulate matter that then escapes the airstream 146 to travel above the upper edge of the rising impermeable barrier 144 would then tend to travel towards the upper vacuum mechanism 120 via the airstream 142 guided by the projecting hanging impermeable barriers 124 and 126, respectively. As such, the amount of airborne particulate matter that is able to travel from the seating area 112 to the seating area 114 is greatly minimalized. While the impermeable barrier 134 is shown as projecting from an opening of the lower vacuum mechanism 130, in some embodiments the impermeable barrier 134 could hang from a bottom of an opening in a table, providing some space below the impermeable barrier 134, such as 18 inches, allowing for the lower vacuum mechanism 130 to be placed underneath it. In some embodiments the bottom edge of the impermeable barrier 134 could be configured to mate with an upper side of the lower vacuum mechanism 130.

While two vacuum mechanisms are shown (an upper vacuum mechanism 120 and a lower vacuum mechanism 130), more or less vacuum mechanisms could be utilized in other embodiments. For example, a single vacuum mechanism having a motor and a fan could have two conduits that lead to the upper vacuum mechanism 120 and the lower vacuum mechanism 130, respectively, that act as two separate input ports of the common vacuum mechanism, or the upper vacuum mechanism could comprise a plurality of vacuum mechanisms, each having a discrete motor, fan, and inlet port and/or the lower vacuum mechanism could comprise a plurality of vacuum mechanisms, each having a discrete motor, fan, and inlet port. In some embodiments, each of the upper vacuum mechanism 120 and the lower vacuum mechanism 130 comprise input ports having conduits that both lead to a common HVAC filtration system of a room or a building, which could then filter and sanitize the drawn air before it is pumped back into the room.

Figure 2:
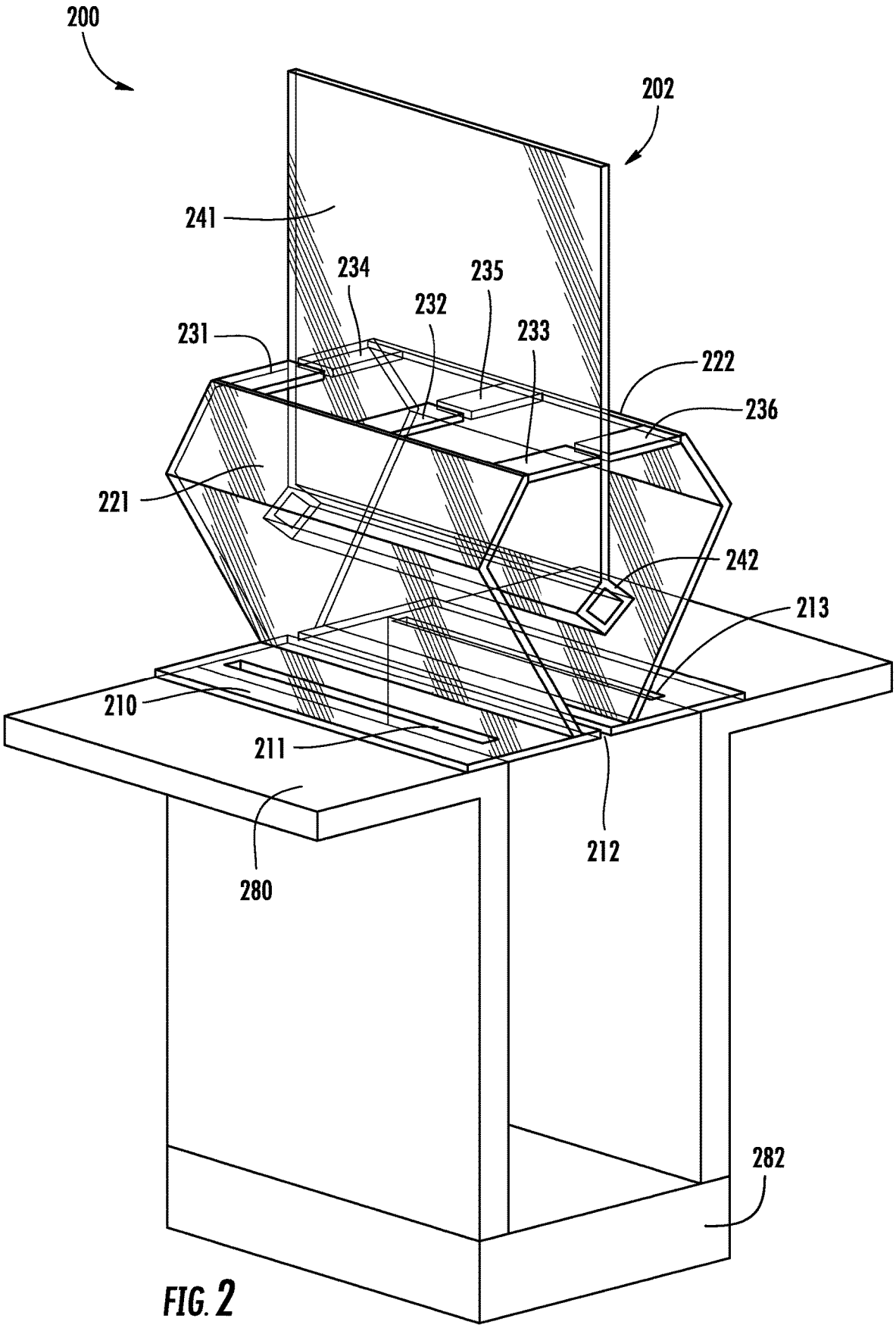
FIG. 2 shows a top perspective view of an alternative table that mitigates infectious disease spread between two people sitting at the table.
Figure 3:
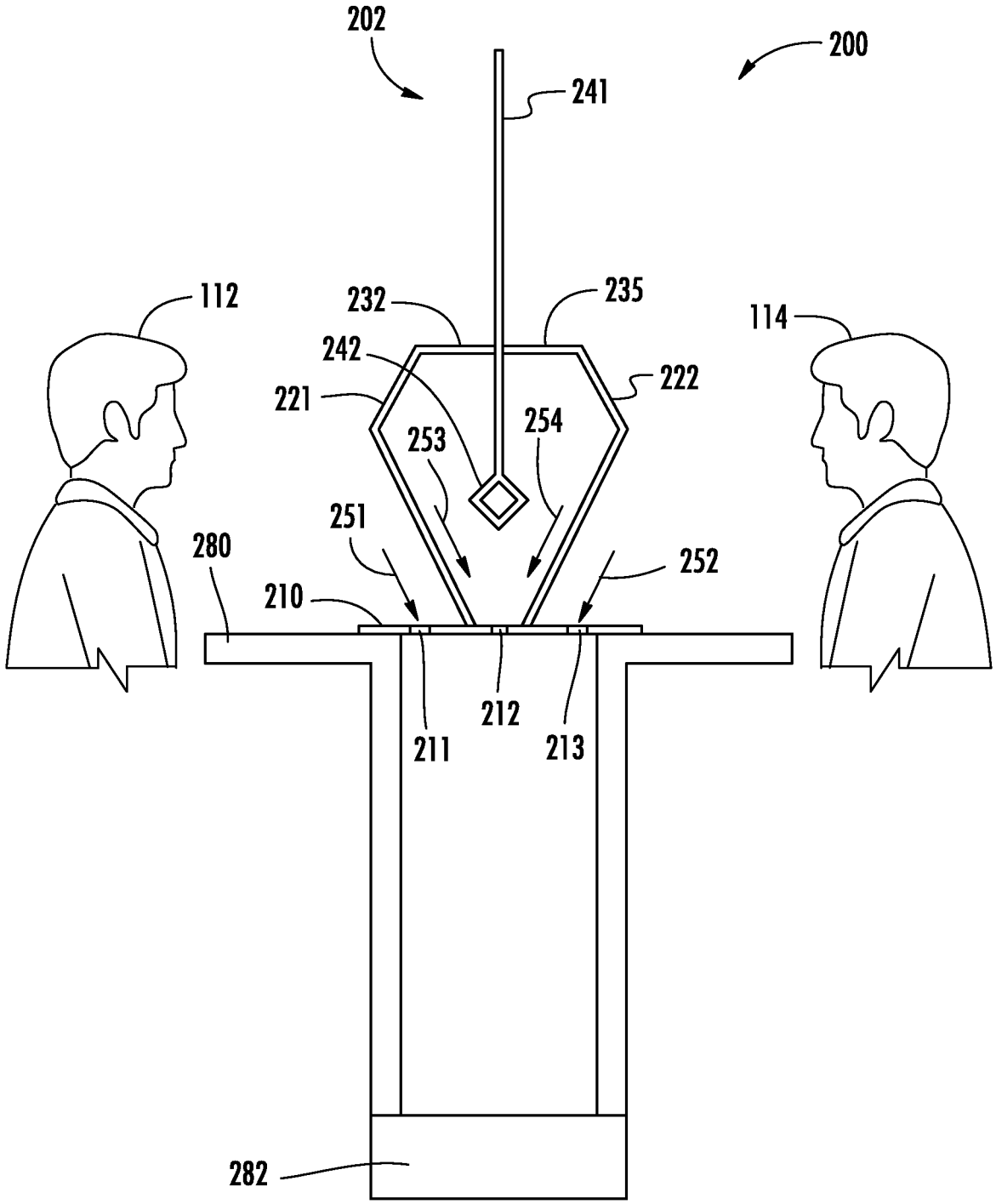
FIG. 3 shows a side cross-sectional view of the table of FIG. 2

FIGS. 2 and 3 show the table 200 having a sanitation mitigation device 202 that is designed to cover an opening in a table surface 280. The sanitation mitigation device 202 is a portable device that can be placed on any suitable table surface 280 having an opening for a lower vacuum mechanism 282 to draw air into the opening and help mitigate infectious disease spread. In some embodiments, the sanitation mitigation device 202 could be coupled to a table 200 in a mechanical manner that allows a user to use the sanitation mitigation device 202 to separate the seating areas 112 and 114, or not use the sanitation mitigation device 202 to separate the seating areas 112 and 114. For example the sanitation mitigation device 202 could be coupled to the table 200 via a sliding mechanism that allows the sanitation mitigation device 202 to slide between a ready-to-use position directly between the seating areas 112 and 114 and a storage position to a side of the table 200. In some embodiments, the table 200 could comprise a cavity located underneath the table surface 280 configured to hide the sanitation mitigation device 202 from view when looking at the table surface 280 from above, allowing the sanitation mitigation device 202 to be stored away when not in use.

The table 200 comprises a hanging impermeable barrier 241 that projects downwards towards a table surface 280 of the table 200. Here, the hanging impermeable barrier 241 has an upper edge that is not attached to a hanging element located above the hanging impermeable barrier 241, such as an upper vacuum mechanism, a ceiling, or a beam. Instead, the hanging impermeable barrier 241 is coupled to the rising impermeable barriers 221 and 222 via bridges 231, 232, 233, 234, 235, and 236. While six bridges are shown to support the hanging impermeable barrier 241, more or less bridges could be used in alternative embodiments. The hanging impermeable barrier 241 extends downwards towards the table surface 280 of the table 200, forming a lower edge 242 shown as a diamond having a width thicker than the width of the main body of the hanging impermeable barrier 241. The upper edges of the rising impermeable barriers 221 and 222 are configured to be disposed at a height above the lower edge 242 of the hanging impermeable barrier 241. By overlapping the impermeable barriers in such a manner, the impermeable barriers block a direct line-of-sight pathway between the seating areas 112 and 114, requiring an aerosolized droplet to zig-zag around the impermeable barriers in order to pass from one seating area to another seating area.

The sanitation mitigation device 202 has a base 210 having a plurality of openings 211, 212, and 213 that allow air to be drawn into the lower vacuum mechanism 282 via the airstreams 251, 253/254, and 252, respectively. Each of the air streams 253 and 254 are drawn into the single opening 212 disposed in the base 210. The base 210 has a width that covers the opening in the table surface 280 of the table 200, reducing the airstreams drawn into the opening of the lower vacuum mechanism 282 to only the three openings 211, 212, and 213.

In some embodiments, the central hanging impermeable barrier 241 could extend upwards by a minimum threshold distance, such as 3 ft., 6 ft. 9 ft. or 12 ft., which would prevent a majority of airborne particulate matter that is expelled from a person within a sitting area from traveling above the upper edge of the central hanging impermeable barrier 241. As stated above, in some embodiments the central hanging impermeable barrier 241 could extend upwards to touch a hanging element, such as an upper vacuum mechanism (not shown) or a ceiling (not shown), which further helps to prevent airborne particulate matter from drifting above the upper edge of the central hanging impermeable barrier 241 to travel from one seating area to another seating area.

In some embodiments, the central hanging impermeable barrier 241 could have an upper edge that is configured to mechanically couple with an element disposed above the table surface 280, such as an upper vacuum mechanism (similar to the upper vacuum mechanism 120) or a ceiling beam. For example, an upper vacuum mechanism could have an elongated recess similar to a track of a sliding door that the central hanging impermeable barrier 241 slides into when disposing the sanitation mitigation device 202 above a hole of the table surface 280. In such embodiments, the elongated recess could bisect an opening of the upper vacuum mechanism such that the upper vacuum mechanism draws air upwards located on both sides of the central hanging impermeable barrier 241, creating two airstreams directed upwards towards the upper vacuum mechanism. In some embodiments, the upper vacuum mechanism could have two separate intake openings that could have walls that are configured to be juxtaposed to either side of the central hanging impermeable barrier 241 to draw air upwards. While the hanging impermeable barrier 241 is shown as projecting straight vertically towards the table surface 280, the hanging impermeable barrier 241 could project towards the table surface 280 at any suitable angle, or could be bent along one or more non-straight paths as it projects downwards towards the table surface 280. While a single hanging impermeable barrier 241 is shown, a plurality of hanging impermeable barriers could project downwards towards the table surface 280 to block airflow between the table seating 112 and the table seating 114.

FIG. 4 shows a top plan view of an alternative table 300 that mitigates infectious disease spread between a plurality of user seating areas disposed along a perimeter of the table 300 sitting at a table. Each of the seating areas 301, 302, 303, 304, 305, and 306 have overlapping hanging and rising impermeable barriers and vacuum mechanisms disposed between the seating areas, similar to those for the table 100 and the table 200. As shown, the seating area 301 is isolated from the seating area 306 by a hanging impermeable barrier 311 projecting downwards towards the table surface 350, similar to the central hanging impermeable barrier 126, and a pair of rising impermeable barriers 331, 334, that project upwards away from the table surface 350, similar to the rising impermeable barriers 132 and 133. The impermeable barriers 331, 311, and 334 are disposed vertically, and are not angled in the manner of the impermeable barriers of the tables 100 and 200 to save space. A lower vacuum mechanism 321 is disposed between the rising impermeable barriers 331 and 334 to suck aerosolized droplets downwards towards the surface 350 of the table 300. While the lower vacuum mechanism 321 is shown here as having an opening disposed between the rising impermeable barriers 331 and 334, the rising impermeable barriers 331 and 334 could be disposed to project from an opening of the lower vacuum mechanism 312 in other embodiments, or could have several openings disposed on either side of the rising impermeable barriers 331 and 334 in other embodiments.

Similarly, the seating area 301 is also isolated from the seating area 302 by a hanging impermeable barrier 312 projecting downwards towards the table surface 350 and a pair of rising impermeable barriers 332, 333 that project upwards away from the table surface 350. Any aerosolized droplets that travel between the seating area 301 and the seating area 302 are drawn downwards towards the lower vacuum mechanism 322.

In one embodiment, each of the lower vacuum mechanisms could comprise a separate motor and fan to draw air downwards into a conduit or a cavity located in the table. In another embodiment, each of the lower vacuum mechanisms could comprise an input port and a conduit that leads to a common motor and fan. In some embodiments, each of the lower vacuum mechanisms could comprise an input port having a filter that helps to mitigate particulate matter drawn into a cavity of the lower vacuum. By disposing filters in each lower vacuum mechanism, particulate matter collected by a common ventilation unit coupled to each of the lower vacuum mechanisms by conduits could be minimized. Such filters are particularly helpful in embodiments where people sitting at a common table are eating food that may be drawn into a lower vacuum mechanism.

By disposing the overlapping hanging and rising impermeable barriers between the seating areas 301, 302, 303, 304, 305, and 306, the seating areas about the periphery of the table 300 are disposed to mitigate infectious disease spread between the seating areas. The hanging impermeable barriers, such as the hanging impermeable barriers 311 and 312, are shown as projecting beyond the outside edges of the table surface 350 to further isolate the seating areas from one another, although in some embodiments the hanging impermeable barriers could have a length that terminates at an outside edge of the table surface 350. In some embodiments, the rising impermeable barriers could also have a length that extends beyond the outside edges of the table surface 350 to mitigate infectious disease spread between the seating areas.

A center 352 of the table could be shared among the seating areas 301, 302, 303, 304, 305, and 306 to allow the diners to share food among one another while a hanging impermeable barrier 340 projects downwards towards the table surface 350 to minimize droplet spread towards the shared center of the table 352. The distance between opposing seating areas, such as the seating area 301 and the seating area 304, is at least 3 feet, 6 feet, 9 feet, or 12 feet away from one other in order to mitigate airborne particulates that may travel under the hanging impermeable barrier 340 across the table 300. A rotating serving device, such as a Lazy Susan, could be disposed at the center 352 to allow items to be easily distributed to the different seating areas without necessitating people disposed in each seating area to reach over the table 300 to reach items in the center 352.

In some embodiments, an upper vacuum mechanism (not shown) could be disposed above the table 300 to direct air flow upwards. The upper vacuum mechanism could have input ports disposed on both sides of each of the hanging impermeable barriers to concentrate air flow directed upwards about both sides of the hanging impermeable barriers upwards to the upper vacuum mechanism. In some embodiments, several upper vacuum mechanisms could be disposed about the table 300, one for each hanging impermeable barrier. In other embodiments, a single upper vacuum mechanism could be disposed to have an input port that covers the entire area of the center 352.

FIG. 5 shows a top plan view of an alternative table 400 that mitigates infectious disease spread between five people sitting at a table and a server located behind a barrier at the table. Similar to the table 300, the table 400 has five seating areas 401, 402, 404, 405, and 406, with overlapping hanging and rising impermeable barriers disposed between the seating areas, and the hanging impermeable barrier 440 disposed between the seating areas and the center of the table 400.

The table 400 could be used to allow a common server 460 to distribute items, such as food in a restaurant setting or cards in a casino setting, to each of the seating areas 401, 402, 404, 405, and 406 from a center area 452 of the shared table 400. Similar to the table 300 shown in FIG. 4, the seating areas 401, 402, 404, 405, and 406 could be substantially isolated from one another via overlapping hanging and rising impermeable barriers and vacuum mechanisms. However, instead of allowing each person in each seating area to reach towards the center 352 of the table 300, the common server 460 of table 400 could distribute items to each of the seating areas from the center area 452, helping to mitigate the spread of infectious diseases by allowing one masked, hygienic entity to distribute items from a centralized location. The common server 460 is located behind the hanging impermeable barrier 440, which suffices to block a majority of particulate matter that might be exhaled from the server 460 from traveling to any of the seating areas 401, 402, 404, 405, and 406—particularly if the server 460 is standing and is masked. Such a configuration also ensures one-way travel of items from the center of the table 400 to each of the serving areas 401, 402, 404, 405, and 406, which minimizes the spread of infectious disease between areas of the table 400. In this manner, a masked server could safely pass along items from the center of the table 400 to each of the serving areas 401, 402, 404, 405, and 406 while minimizing the chance of airborne particulate matter from being transmitted from the eyes and nose of the server to the serving areas, and while minimizing the chance of airborne particulate matter from traveling into the center area 452.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An apparatus for a table having a first user seating area and a second user seating area, comprising:

a first vacuum mechanism having a first input opening disposed to draw air between the first and second user seating areas towards a downward direction;

a central hanging impermeable barrier disposed between the first user seating area and the second user seating area that projects downward towards an upper surface of the table;

a first rising impermeable barrier disposed between the central hanging impermeable barrier and the first user seating area that projects upwards away from the upper surface of the table; and a second rising impermeable barrier disposed between the central hanging impermeable barrier and the second user seating area that projects upwards away from the upper surface of the table.

2. The apparatus of claim 1, wherein a lower edge of the central hanging impermeable barrier is disposed at a lower height than an upper edge of the first rising impermeable barrier.

3. The apparatus of claim 1, wherein the first rising impermeable barrier also projects towards the first user seating area, and wherein the second rising impermeable barrier also projects towards the second user seating area.

4. The apparatus of claim 1, wherein the first rising impermeable barrier projects from the first input opening of the first vacuum mechanism and wherein the second rising impermeable barrier projects from the first input opening of the first vacuum mechanism.

5. The apparatus of claim 1, wherein the central hanging impermeable barrier comprises a transparent material.

6. The apparatus of claim 1, further comprising a second vacuum mechanism having a second opening disposed to draw air between the first and second user seating areas towards an upwards direction.

7. The apparatus of claim 6, wherein the central hanging impermeable barrier projects from a second opening of the second vacuum mechanism.

8. The apparatus of claim 6, further comprising:

a first hanging impermeable barrier disposed above the first user seating area that projects downward towards the upper surface of the table; and a second hanging impermeable barrier disposed above the second user seating area that projects downward towards the upper surface of the table.

9. The apparatus of claim 8, wherein the first hanging impermeable barrier also projects away from the central hanging impermeable barrier, and wherein the second hanging impermeable barrier also projects away from the central hanging impermeable barrier.

10. The apparatus of claim 1, further comprising a sanitation mitigation device comprising the central hanging impermeable barrier coupled to the first rising impermeable barrier and the second rising impermeable barrier via a plurality of bridges.

11. The apparatus of claim 10, wherein the sanitation mitigation device comprises a base, wherein the first input opening of the first vacuum mechanism is disposed to draw air from a hole in a table, and wherein the base of the sanitation mitigation device is disposed to cover the hole in the table.

12. A table for mitigating infectious disease, comprising:

a first user seating area;

a second user seating area;

a first vacuum mechanism that sucks air between the first and second user seating areas towards a downward direction;

a second vacuum mechanism that sucks air between the first and second user seating areas towards an upwards direction;

a first bisecting hanging impermeable barrier disposed between the first user seating area and the second user seating area that projects downward towards an upper surface of the table;

a first rising impermeable barrier disposed between the first bisecting hanging impermeable barrier and the first user seating area that projects upwards away from the upper surface of the table; and a second rising impermeable barrier disposed between the first bisecting hanging impermeable barrier and the second user seating area that projects upwards away from the upper surface of the table.

13. The table of claim 12, further comprising:

a third user seating area;

a second bisecting hanging impermeable barrier disposed between the second user seating area and the third user seating area that projects downward towards the upper surface of the table;

a third rising impermeable barrier disposed between the second bisecting hanging impermeable barrier and the second user seating area that projects upwards away from the upper surface of the table; and a fourth rising impermeable barrier disposed between the second bisecting hanging impermeable barrier and the third user seating area that projects upwards away from the upper surface of the table.

14. The table of claim 13, further comprising first and second vacuum mechanisms, and wherein the second vacuum mechanism sucks air between the second and third user seating areas towards an upwards direction, and wherein the first vacuum mechanism sucks air between the second and third seating areas towards a downward direction.

15. The table of claim 13, wherein a third vacuum mechanism sucks air between the second and third user seating areas towards an upwards direction, and wherein a fourth vacuum mechanism sucks air between the second and third seating areas towards a downward direction.

16. The table of claim 13, further comprising a cavity comprising a cavity impermeable barrier disposed between the cavity and the first, second, and third user seating areas.

17. The table of claim 16, wherein the cavity impermeable barrier projects downward towards the upper surface of the table.

18. The table of claim 16, wherein the cavity impermeable barrier comprises an opening disposed opposite the second user seating area to allow a person to enter the cavity and place items in the first, second, and third user seating areas.

19. The table of claim 16, further comprising a perimeter hanging impermeable barrier that projects downward towards the upper surface of the table and projects away from the cavity.

* * * * *